US009478343B2

(12) United States Patent
Morita et al.

(10) Patent No.: US 9,478,343 B2
(45) Date of Patent: Oct. 25, 2016

(54) PRINTED WIRING BOARD

(71) Applicant: IBIDEN CO., LTD., Ogaki-shi (JP)

(72) Inventors: Haruhiko Morita, Ogaki (JP); Yasuhiko Mano, Ogaki (JP); Kazuhiro Yoshikawa, Ogaki (JP)

(73) Assignee: IBIDEN CO., LTD., Ogaki-shi (JP)

( * ) Notice: Subject to any disclaimer, the term of this patent is extended or adjusted under 35 U.S.C. 154(b) by 72 days.

(21) Appl. No.: 14/178,600

(22) Filed: Feb. 12, 2014

(65) Prior Publication Data

US 2014/0225701 A1 Aug. 14, 2014

(30) Foreign Application Priority Data

Feb. 13, 2013 (JP) ..... 2013-025486

(51) Int. Cl.
*H01F 5/00* (2006.01)
*H01F 17/00* (2006.01)

(52) U.S. Cl.
CPC ... *H01F 17/0013* (2013.01); *H01F 2017/0066* (2013.01)

(58) Field of Classification Search
CPC ..... H01F 27/2804; H01F 41/041; H01F 17/0006; H01F 5/0003; H01F 2017/002; H01L 23/50; H01L 23/645; H01L 23/49827; H01L 2924/15153
USPC ..... 336/200, 192
See application file for complete search history.

(56) References Cited

U.S. PATENT DOCUMENTS 5,070,317 A * 12/1991 Bhagat ..... B81B 7/0077 257/531
7,271,697 B2 * 9/2007 Whittaker ..... H01F 17/0033 336/229
7,423,418 B2 * 9/2008 Higashitani ..... H01L 21/4857 257/E21.503
8,119,040 B2 * 2/2012 Lower ..... H05K 1/162 106/634
2004/0145874 A1 * 7/2004 Pinel ..... H01L 23/5389 361/748
2006/0267718 A1 * 11/2006 Salama ..... H01F 17/0033 336/200
2008/0169896 A1 * 7/2008 Edo ..... H01F 17/0033 336/200
2008/0290496 A1 * 11/2008 Park ..... H01L 21/6835 257/693
2010/0201003 A1 * 8/2010 Thompson ..... B81B 7/0041 257/788
2011/0102122 A1 * 5/2011 Mano ..... H01F 17/0006 336/200
2011/0114732 A1 * 5/2011 Reignoux ..... G06K 19/025 235/488
2012/0212919 A1 * 8/2012 Mano ..... H05K 1/185 361/782
2013/0146345 A1 6/2013 Kajihara et al.
2014/0027165 A1 1/2014 Morita et al.

FOREIGN PATENT DOCUMENTS

JP 2008-270532 11/2008

* cited by examiner

*Primary Examiner* — Alexander Talpalatski
*Assistant Examiner* — Joselito Baisa
(74) *Attorney, Agent, or Firm* — Oblon, McClelland, Maier & Neustadt, L.L.P.

(57) ABSTRACT

A printed wiring board includes a first core substrate having an opening portion, an inductor component accommodated in the opening portion of the first core substrate, a first buildup layer formed on a first surface of the first core substrate and the inductor component, and a second buildup layer formed on a second surface of the first core substrate and the inductor component on the opposite side with respect to the first surface of the first core substrate. The inductor component has a second core substrate, a buildup layer formed on a surface of the second core substrate and a coil layer formed on the buildup layer, and the second buildup layer has a coil layer and a via conductor connecting the coil layer in the second buildup layer and the coil layer formed on the buildup layer in the inductor component.

11 Claims, 14 Drawing Sheets

(A)

(B)

(C)

PRINTED WIRING BOARD

CROSS-REFERENCE TO RELATED APPLICATIONS

The present application is based upon and claims the benefit of priority to Japanese Patent Application No. 2013-025486, filed Feb. 13, 2013, the entire contents of which are incorporated herein by reference.

BACKGROUND OF THE INVENTION

1. Field of the Invention

The present invention relates to a printed wiring board with a built-in inductor.

2. Description of the Background Art

In a printed wiring board with a mounted IC chip, a decoupling inductor may be provided between a VRM (voltage regulating module) and an IC chip. For example, JP 2008-270532 A describes a printed wiring board with a built-in inductor, and a method for manufacturing an inductor from a metal plate. According to JP 2008-270532 A, the inductor is bonded on a substrate, and a printed wiring board with the built-in inductor is manufactured as illustrated in FIG. 6 of JP 2008-270532 A. In addition, JP 2008-270532 A describes a method for increasing the thickness of an inductor by manufacturing the inductor through a pressing process. The entire contents of this publication are incorporated herein by reference.

SUMMARY OF THE INVENTION

According to one aspect of the present invention, a printed wiring board includes a first core substrate having an opening portion, an inductor component accommodated in the opening portion of the first core substrate, a first buildup layer formed on a first surface of the first core substrate and the inductor component, and a second buildup layer formed on a second surface of the first core substrate and the inductor component on the opposite side with respect to the first surface of the first core substrate. The inductor component has a second core substrate, a buildup layer formed on a surface of the second core substrate and a coil layer formed on the buildup layer, and the second buildup layer has a coil layer and a via conductor connecting the coil layer in the second buildup layer and the coil layer formed on the buildup layer in the inductor component.

According to another aspect of the present invention, a printed wiring board includes a core substrate having an opening portion, an inductor component accommodated in the opening portion of the core substrate, a first buildup layer formed on a first surface of the core substrate and the inductor component, and a second buildup layer formed on a second surface of the core substrate and the inductor component on the opposite side with respect to the first surface of the core substrate. The inductor component has an insulating substrate, an electrode formed on a surface of the insulating substrate, and a coil layer formed on a surface of the insulating substrate on the opposite side with respect to the electrode, and the second buildup layer has a coil layer and a via conductor structure connecting the coil layer in the inductor component and the coil layer in the second buildup layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
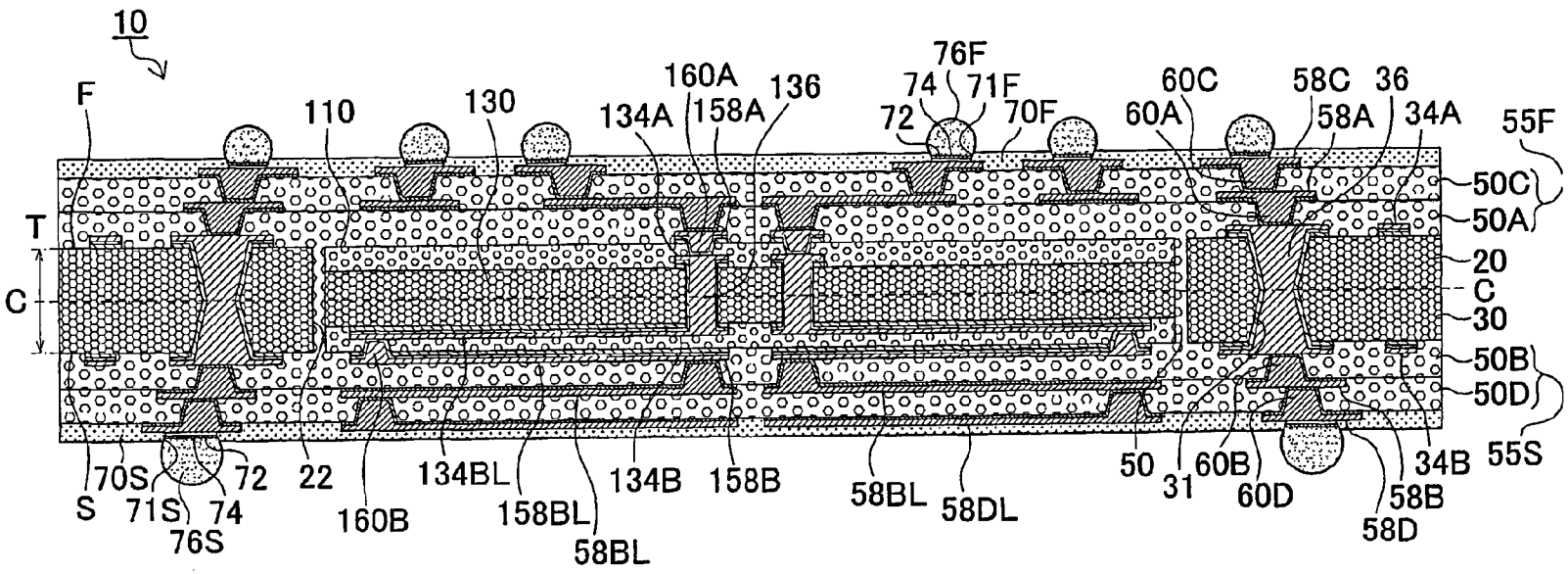
FIG. 1 is a cross-sectional view of a printed wiring board according to a first embodiment of the present invention.

The embodiments will now be described with reference to the accompanying drawings, wherein like reference numerals designate corresponding or identical elements throughout the various drawings.

First Embodiment

FIG. 1 is a cross-sectional view of a printed wiring board 10 according to a first embodiment of the present invention. The printed wiring board 10 includes a first core substrate 30 having a first surface (F) and a second surface (S) opposite the first surface (F), a first buildup layer (55F) formed on the first surface (F) of the first core substrate 30, and a second buildup layer (55S) formed on the second surface (S) of the first core substrate 30.

The first core substrate 30 is made up of an insulative base material (base material) 20 having a first surface and a second surface opposite the first surface, a first conductive layer (34A) formed on the first surface of the insulative base material 20, a second conductive layer (34B) formed on the second surface of the insulative base material 20, and a through-hole conductor 36, which penetrates through the insulative base material 20 and connects the first and second conductive layers (34A, 34B) to each other. The first surface of the insulative base material 20 corresponds to the first surface of the first core substrate 30, and the second surface of the insulative base material 20 corresponds to the second surface of the first core substrate 30.

The first buildup layer (55F) is made up of an upper interlayer insulation layer (50A) formed on the first surface (F) of the first core substrate 30; an upper conductive layer (58A) formed on the upper interlayer insulation layer (50A), an upper via conductor (60A), which penetrates through the upper interlayer insulation layer (50A) and connects the first conductive layer (34A) and the upper conductive layer (58A) to each other; an uppermost interlayer insulation layer (50C) formed on the upper conductive layer (58A) and the upper interlayer insulation layer (50A); an uppermost conductive layer (58C) formed on the uppermost interlayer insulation layer (50C); and an uppermost via conductor (60C), which penetrates through the uppermost interlayer insulation layer (50C) and connects the upper conductive layer (58A) and the uppermost conductive layer (58C) to each other.

On the first buildup layer (55F), a first solder resist layer (70F) is formed, having openings to expose the uppermost via conductor (60C) and the uppermost conductive layer (58C) respectively. The uppermost via conductor (60C) and the uppermost conductive layer (58C) exposed from the opening of the first solder resist layer (70F) each function as a pad.

The second buildup layer (55S) is made up of a lower interlayer insulation layer (50B) formed on the second surface (S) of the first core substrate 30; a lower conductive layer (58B) formed on the lower interlayer insulation layer (50B), a lower via conductor (60B), which penetrates through the lower interlayer insulation layer (50B) and connects the second conductive layer (34B) and the lower conductive layer (58B) to each other; a lowermost interlayer insulation layer (50D) formed on the lower conductive layer (58B) and the lower interlayer insulation layer (50B); a lowermost conductive layer (58D) formed on the lowermost interlayer insulation layer (50D); and a lowermost via conductor (60D) which penetrates through the lowermost interlayer insulation layer (50D) and connects the lower conductive layer (58B) and the lowermost conductive layer (58D) to each other.

On the second buildup layer (55S), a second solder resist layer (70S) is formed, having openings to expose the lowermost via conductor (60D) and the lowermost conductive layer (58D). The lowermost via conductor (60D) and the lowermost conductive layer (58D) exposed from the openings of the second solder resist layer (70S) each function as a pad.

An interlayer insulation layer and an interlayer resin insulation layer are the same.

The insulative base material 20 has a cavity (opening) 22 to accommodate an inductor component 110. The insulative base material is made of resin such as epoxy resin or the like and reinforcing material such as a glass cloth or the like. The thickness (T) of the insulative base material 20 is from 120 μm to 300 μm. In the present embodiment, because of the conductive layer of the first buildup layer, the inductance value and Q factor of the built-in inductor do not decrease. Stable power is supplied to an IC chip. A printed wiring board of the embodiment is made thinner. As illustrated in FIG. 1, the cavity 22 penetrates through the insulative base material 20 and accommodates the inductor component.

Figure 2:
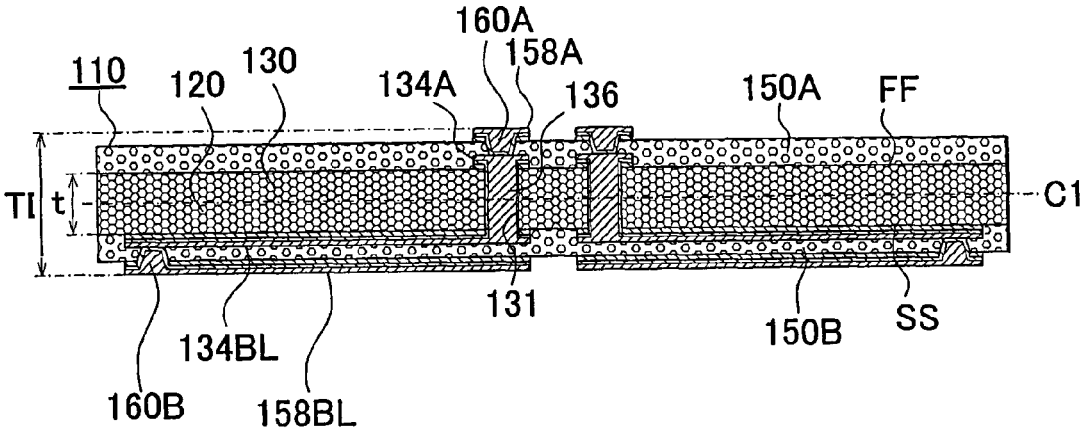
FIG. 2A is a cross-sectional view of an inductor component of the first embodiment.
FIG. 2B is a plan view of a coil layer.
FIG. 2C is a cross-sectional view illustrating a second through-hole conductor.
Figure 2:
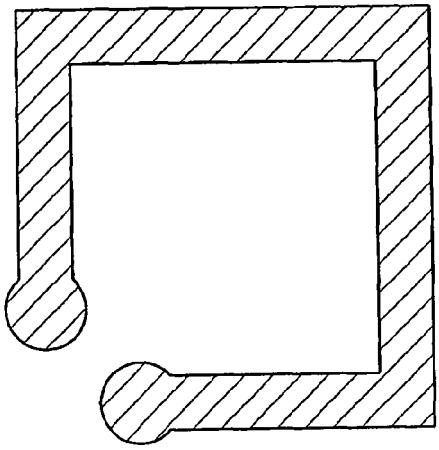
Figure 2:
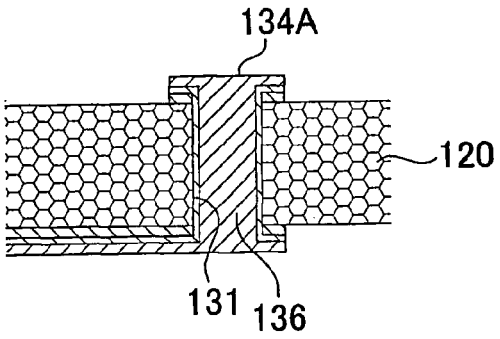

FIG. 2A is a cross-sectional view of the inductor component 110.

The inductor component 110 includes a second core substrate 130 having a third surface (FF) and a fourth surface (SS) opposite the third surface (FF), and a fourth buildup layer formed on the fourth surface of the second core substrate. The inductor component is accommodated in the first core substrate in such a way that the third surface (FF) of the second core substrate 130 faces the first surface of the first core substrate.

The second core substrate 130 is made up of an insulating substrate 120 which has a third surface (FF) and a fourth surface (SS) opposite the first surface and is provided with a through hole 131 for forming a second through-hole conductor 136; a second through-hole conductor 136 formed in the through hole for a second through-hole conductor; a third conductive layer, which is formed on the third surface of the insulating substrate 120 and includes a land (134A) formed around the second through-hole conductor 136; and a first coil layer (134BL) formed on the fourth surface of the insulating substrate 120. The third surface of the second core substrate 130 corresponds to the third surface of the insulating substrate 120, and the fourth surface of the second core substrate 130 corresponds to the fourth surface of the insulating substrate 120. As illustrated in FIG. 2A and FIG. 2C, the land (134A) of the second through-hole conductor 136 may include a conductor formed on the through hole 131 for forming the second through-hole conductor 136. The third conductive layer is preferred not to include any conductive circuit except the land of the second through-hole conductor.

The fourth buildup layer is made up of a lower resin insulation layer (interlayer resin insulation layer) (150B) of the inductor component, a second coil layer (158BL) formed on the lower resin insulation layer (150B) of the inductor component, and a lower via conductor (160B) in the inductor component, which penetrates through the lower resin insulation layer (150B) and connects the first and second coil layers to each other. The second coil layer has a second electrode, which includes a second input electrode and a second output electrode. On the second electrode, there is formed a via conductor (second connection via conductor) of the second buildup layer. The coil layers in the inductor component and the second buildup layer are connected to each other through the second electrode. Since the inductor component in the first core substrate and the second buildup layer each have a coil layer, the number of coil layers increases and the inductance value therefore increases. In addition, since the coil layer is formed in the inductor component in the first core substrate, an inductor having high inductance is formed in a thin printed wiring board according to the present embodiment.

When an inductor component does not include such a buildup layer on the third surface of the second core substrate, the inductor component has a first electrode on the third surface of the second core substrate. The first electrode includes a first input electrode and a first output electrode. A via conductor of the first buildup layer is formed on the first electrode. The first electrode is preferred to be a land of the second through-hole conductor. Except for the electrode, no other conductive circuit is preferred to be formed on the third surface of the second core substrate. The inductance value and Q factor of the inductor built into the printed wiring board of the embodiment will not decrease. If an inductor component does not include the third buildup layer, it is preferred that the inductor component be made up of an insulating substrate, an electrode on the third surface of the insulating substrate, the first coil layer on the fourth surface of the insulating substrate, and a through-hole conductor connecting the first coil layer and the electrode to each other.

It is an option for the inductor component to have a third buildup layer on the third surface of the second core substrate. The third buildup layer of the inductor component has an upper interlayer resin insulation layer (resin insulation layer) (150A), an upper conductive layer (158A) formed on the upper resin insulation layer, and an upper via conductor (160A) that penetrates through the upper resin insulation layer and connects the upper conductive layer and the third conductive layer to each other. It is preferred that the upper conductive layer of the inductor component not include any conductive circuit except for the land formed around the upper via conductor in the inductor component. The part of the upper via conductor extending beyond the upper resin insulation layer in the inductor is included in the land of the upper via conductor in the inductor component. When the inductor component includes the third buildup layer, the inductor component is provided with the first electrode on the upper resin insulation layer in the inductor component. The first electrode includes the first input electrode and the first output electrode. It is preferred that the upper conductive layer in the inductor component not include any conductive circuit except the first electrode. On the first electrode, there is formed a via conductor (first connection via conductor) of the first buildup layer. It is preferred that the first electrode be the land of the upper via conductor in the inductor component. The inductance value and Q factor of the inductor built into the printed wiring board of the embodiment will not decrease.

Figure 3:
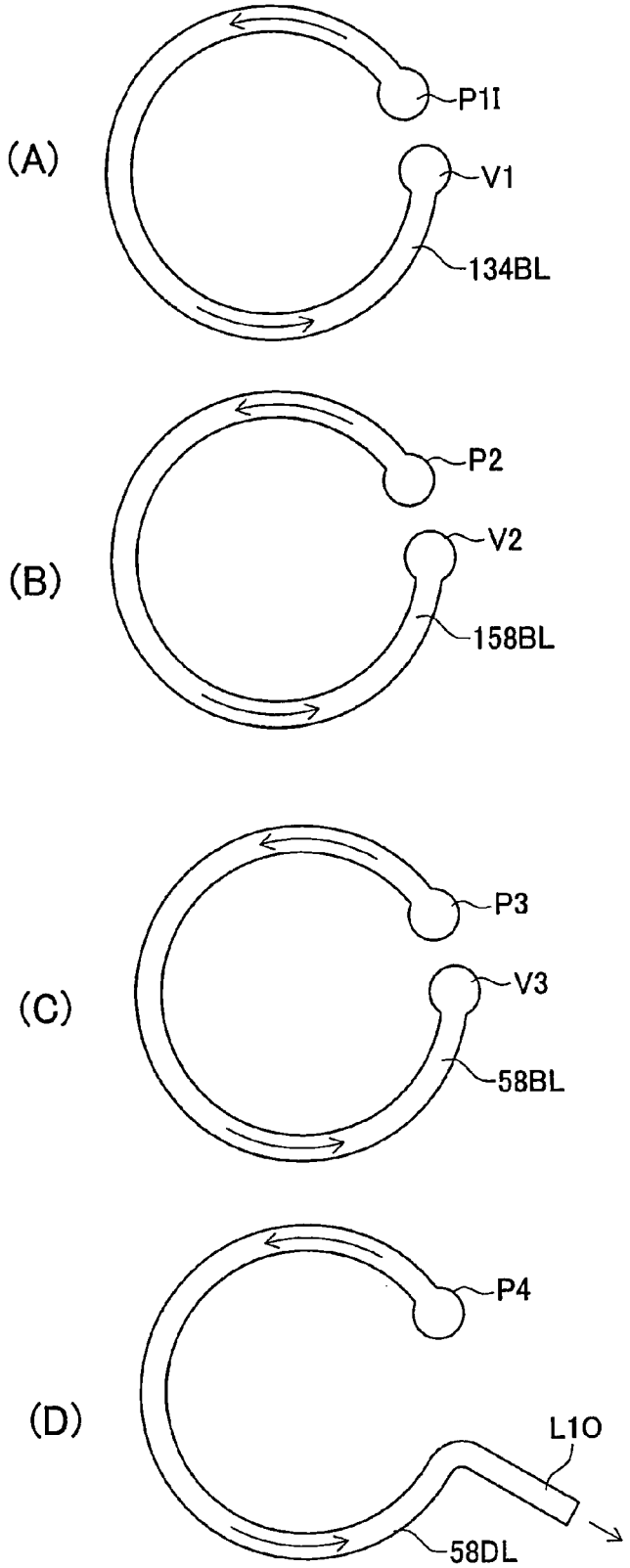
FIGS. 3A to 3D are plan views respectively showing coil layers of the first embodiment.
Figure 4:
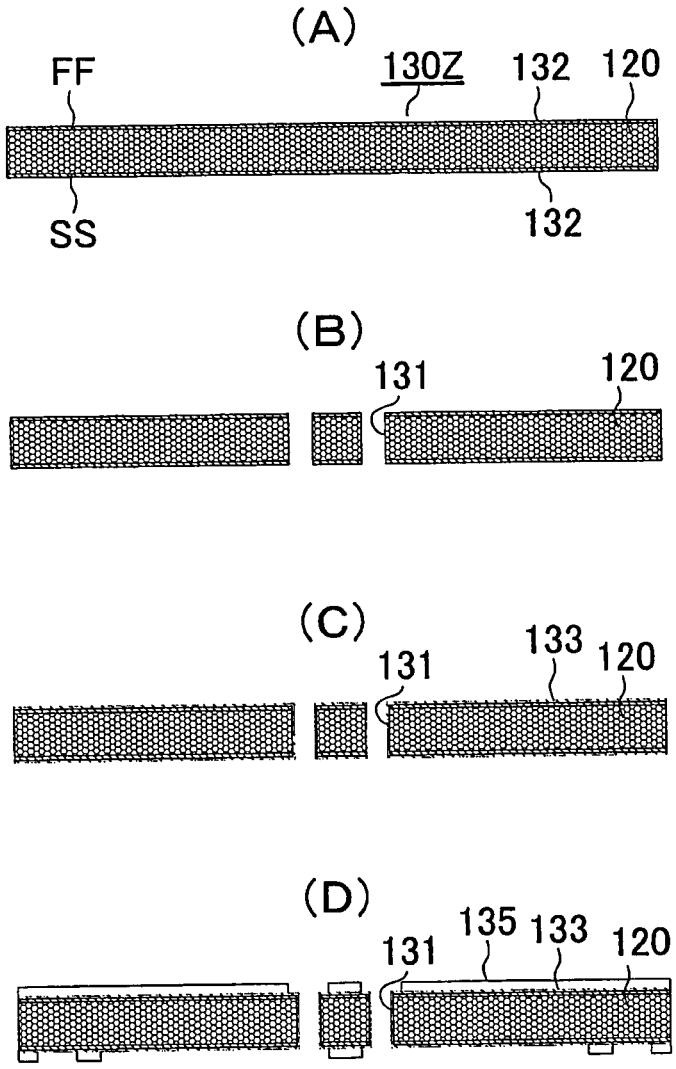
FIGS. 4A to 4D are views illustrating the method for manufacturing an inductor component of the first embodiment.

The lower conductive layer (58B) of the second buildup layer has an inductor pattern (coil layer) (58BL) illustrated in FIG. 3C. FIGS. 3A to 3D are plan views of the respective coil layers. The lowermost conductive layer (58D) has the inductor pattern (coil layer) (58DL). The second electrode in the inductor component and the coil layer (58BL) in the second buildup layer are connected to each other through the lower via conductor (second connection via conductor) formed in the lower interlayer insulation layer. The coil layer (58BL) and the coil layer (58DL) are connected to each other through the via conductor formed in the lowermost interlayer resin insulation layer.

In the present embodiment, the coil in the second buildup layer and the coil in the inductor component are connected to each other, thus increasing the number of coil layers.

The distance between the third surface of the second core substrate and the first surface of the first core substrate is longer than the distance between the fourth surface of the second core substrate and the second surface of the first core substrate. The fourth surface of the second core substrate is positioned closer to the second surface of the first core substrate. The center line (C) (see FIG. 1) and the center line (C1) (see FIG. 2A) do not overlap, and the center line (C1) is closer to the second surface of the first core substrate. The center line is parallel to the surfaces (first and third surfaces) of the respective core substrates, and passes through the center of the insulator (insulative base material, insulating substrate) of each of the core substrates.

A C4 pad is exposed through an opening (71F) of the first solder resist layer (70F) on the first buildup layer (55F), and a C4 bump (76F) for mounting an IC chip on the C4 pad. A BGA pad is exposed through an opening (71S) of the solder resist layer (70S) on the second buildup layer (55S), and a BGA bump (76S) for mounting a motherboard on the BGA pad.

A through hole 31 for forming a first through-hole conductor 36 is provided in the insulative base material 20, and the first through-hole conductor 36 is formed in the through hole 31. The first and second conductive layers (34A, 34B) are connected to each other through the first through-hole conductor 36.

The insulating substrate 120 is formed of a resin such as epoxy resin or the like and reinforcing material such as a glass cloth or the like, the same as with the insulative base material 20. The thickness (T) of the insulating substrate 120 is ½ to ¾ of the thickness of the insulative base material 20. The interference between the coil layer in the inductor component and the upper conductive layer of the first buildup layer weakens. The inductance value and Q factor do not decrease.

The resin insulation layers (150A, 150B) of the inductor component and the interlayer insulation layers (50A, 50B, 50C, 50D) of the buildup layers are formed, for example, by curing a prepreg. The prepreg is formed of a resin and reinforcing material.

FIGS. 3A to 3D illustrate the inductor patterns (coil layers) (134BL, 158BL) in the inductor component and the inductor patterns (coil layers) (58BL, 58DL) in the second buildup layer. The coil layers are each formed of a wiring pattern. The inductor patterns are each formed with a substantially ring-shaped conductor pattern on a plane. The inductor patterns of the respective layers are each formed with a substantially circular conductor pattern. A four-turn inductor is thereby formed. The direction of electric currents flowing in each inductor pattern is the same. The arrows in the drawings indicate the directions of electric currents, which all are counter-clockwise in this example. It is preferred that the inductor patterns be overlaid on each other in a cross-sectional direction. FIGS. 3A to 3D are plan views of each coil layer of one laminated coil. The coil layers (134BL, 158BL, 58BL, 58DL) are connected to each other, forming one laminated coil.

On one of its ends, the first coil layer (134BL) in the inductor component has a land (P1I) of the second through-hole conductor 136. The land (P1I) is formed around the second through-hole conductor 136 on the fourth surface of the second core substrate, and includes the conductor covering the through hole 131 for forming the second through-hole conductor 136. The shape of the land (P1I) is substantially a circle. On the end opposite the land (P1I), the first coil layer (134BL) has a connection portion (V1), which is connected to the via conductor (160B) formed in the resin insulation layer (150B). The first and second coil layers (134BL, 158BL) are connected to each other through the via conductor (160B). The second coil layer (158BL) has a via land (P2), which is formed on one end of the second coil layer (158BL), for connecting to the via conductor (160B). On the end opposite the via land (P2), the second coil layer (158BL) has a connection portion (second electrode) (V2), which is connected to the via conductor (60B) formed in the interlayer insulation layer (50B) of the second buildup layer. The lower via conductor (second connection via conductor) (60B) is formed on the connection portion (V2).

The second coil layer (158BL) in the inductor component and the third coil layer (58BL) in the lower conductive layer are connected to each other through the lower via conductor (60B). The third coil layer (58BL) has a via land (P3) for connection with the lower via conductor (60B). The via land (P3) is formed on one end of the third coil layer (58BL). On the end opposite the via land (P3), the third coil layer (58BL) has a connection portion (V3), which is connected to the lowermost via conductor (60D).

Figure 5:
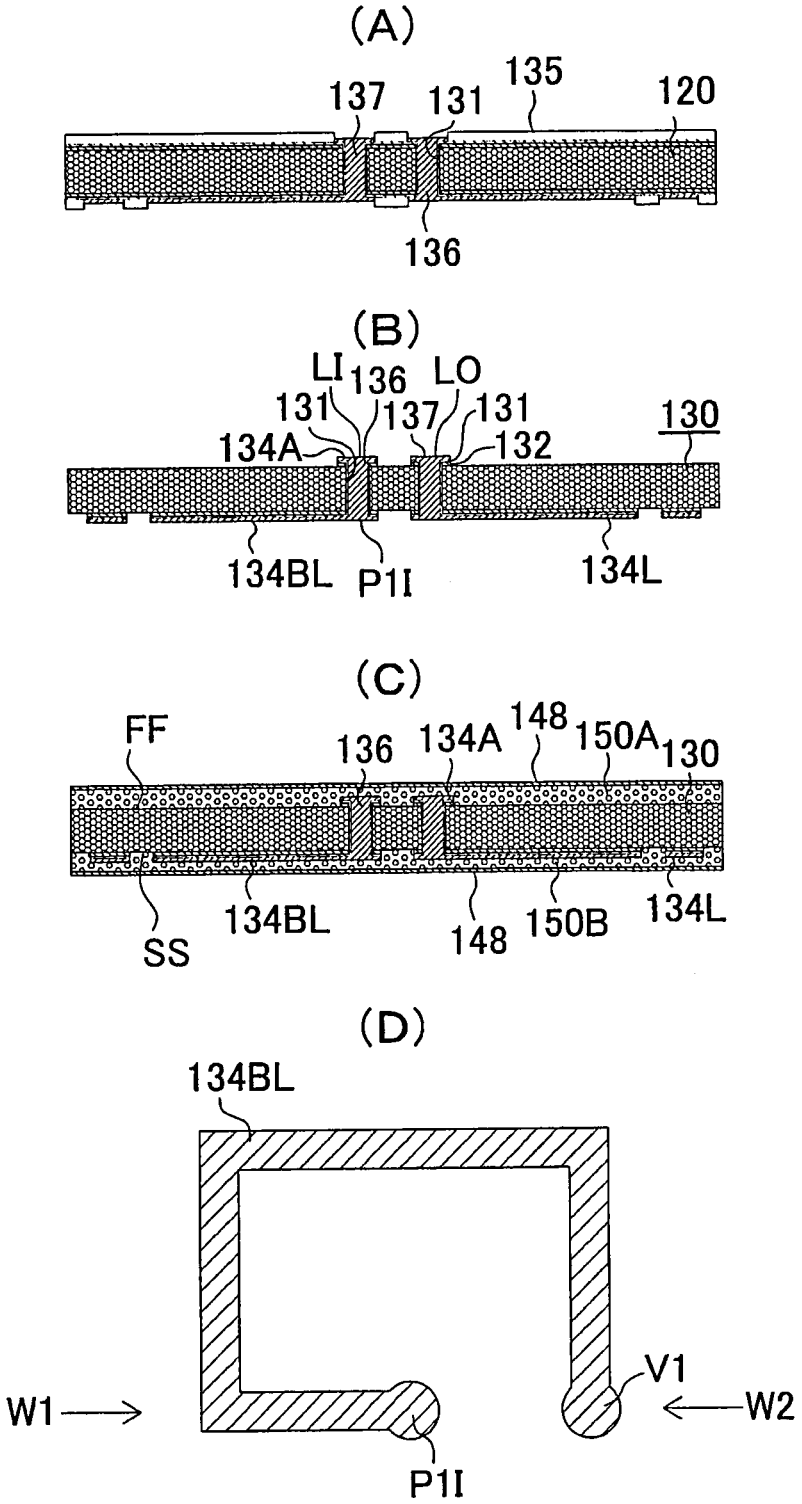
FIGS. 5A to 5D are views illustrating the method for manufacturing the inductor component of the first embodiment.
Figure 6:
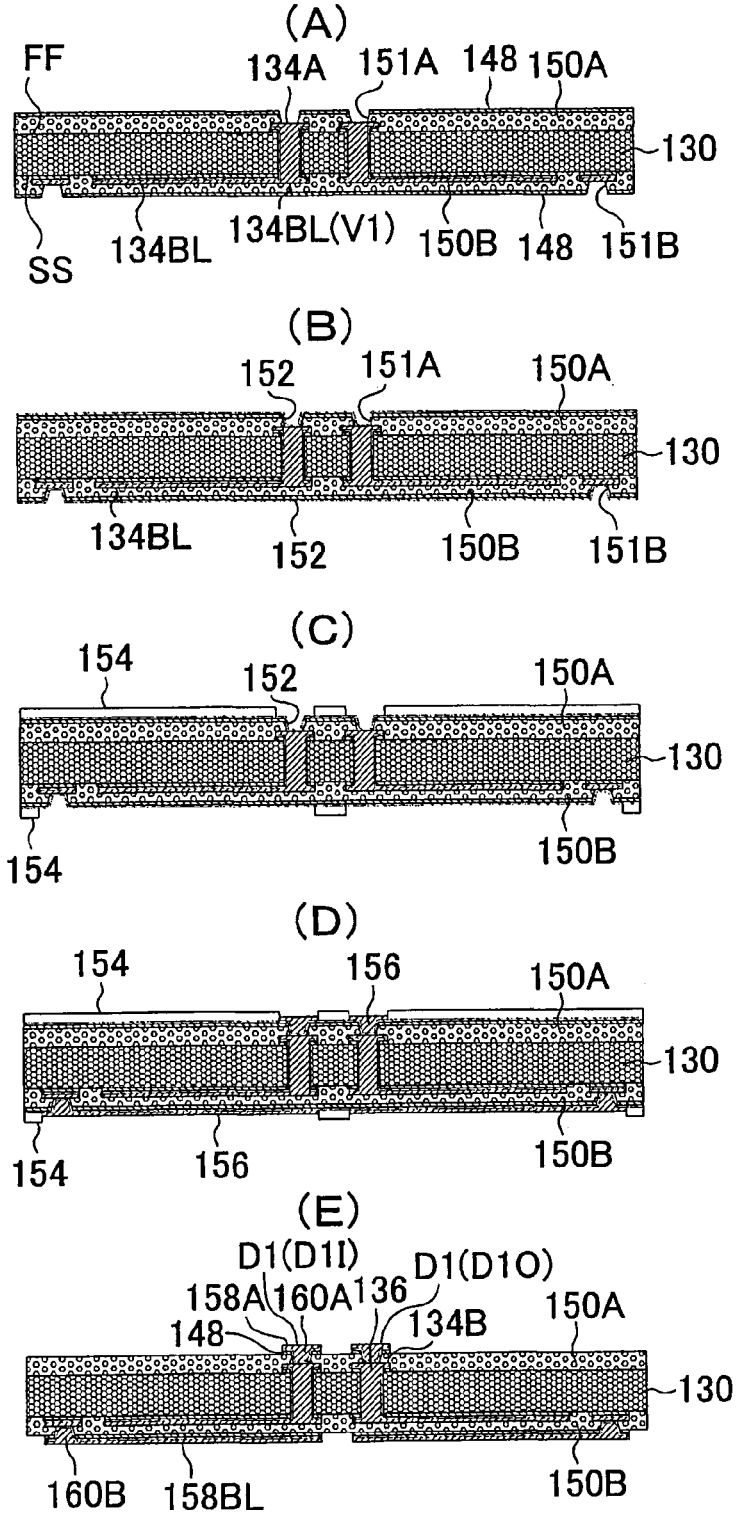
FIGS. 6A to 6E are views illustrating the method for manufacturing the inductor component of the first embodiment.
Figure 7:
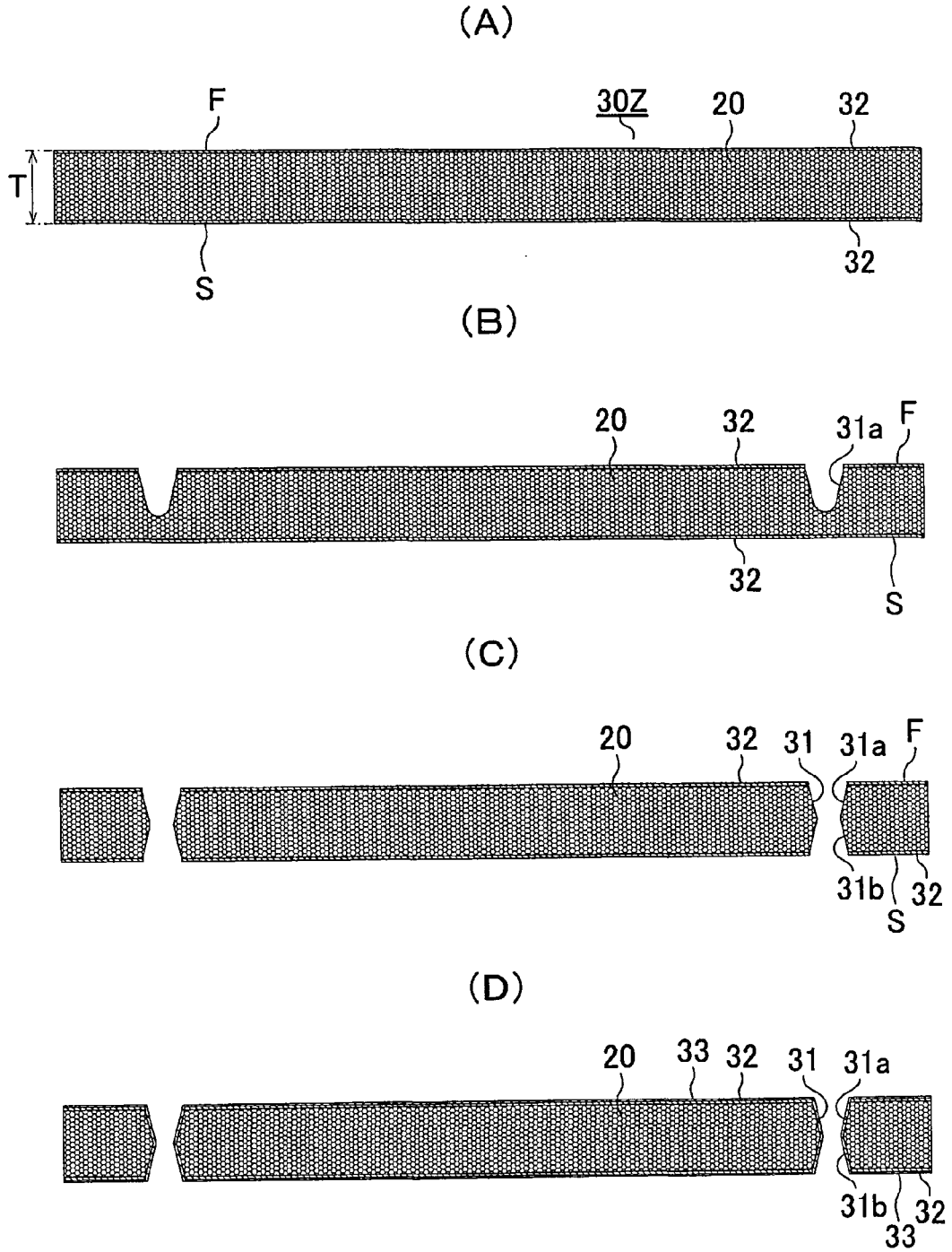
FIGS. 7A to 7D are views illustrating the method for manufacturing a printed wiring board of the first embodiment.
Figure 8:
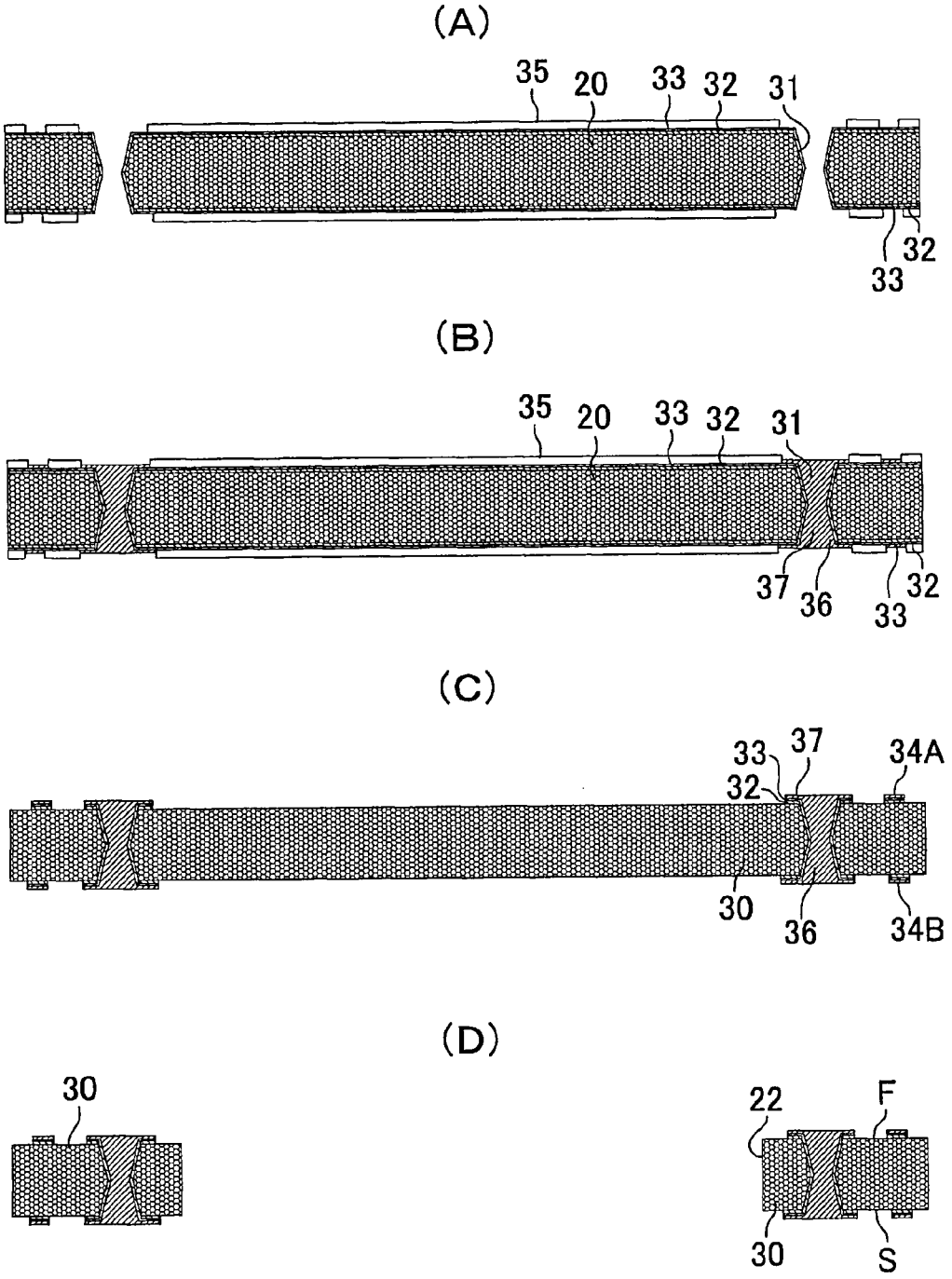
FIGS. 8A to 8D are views illustrating the method for manufacturing the printed wiring board of the first embodiment.
Figure 9:
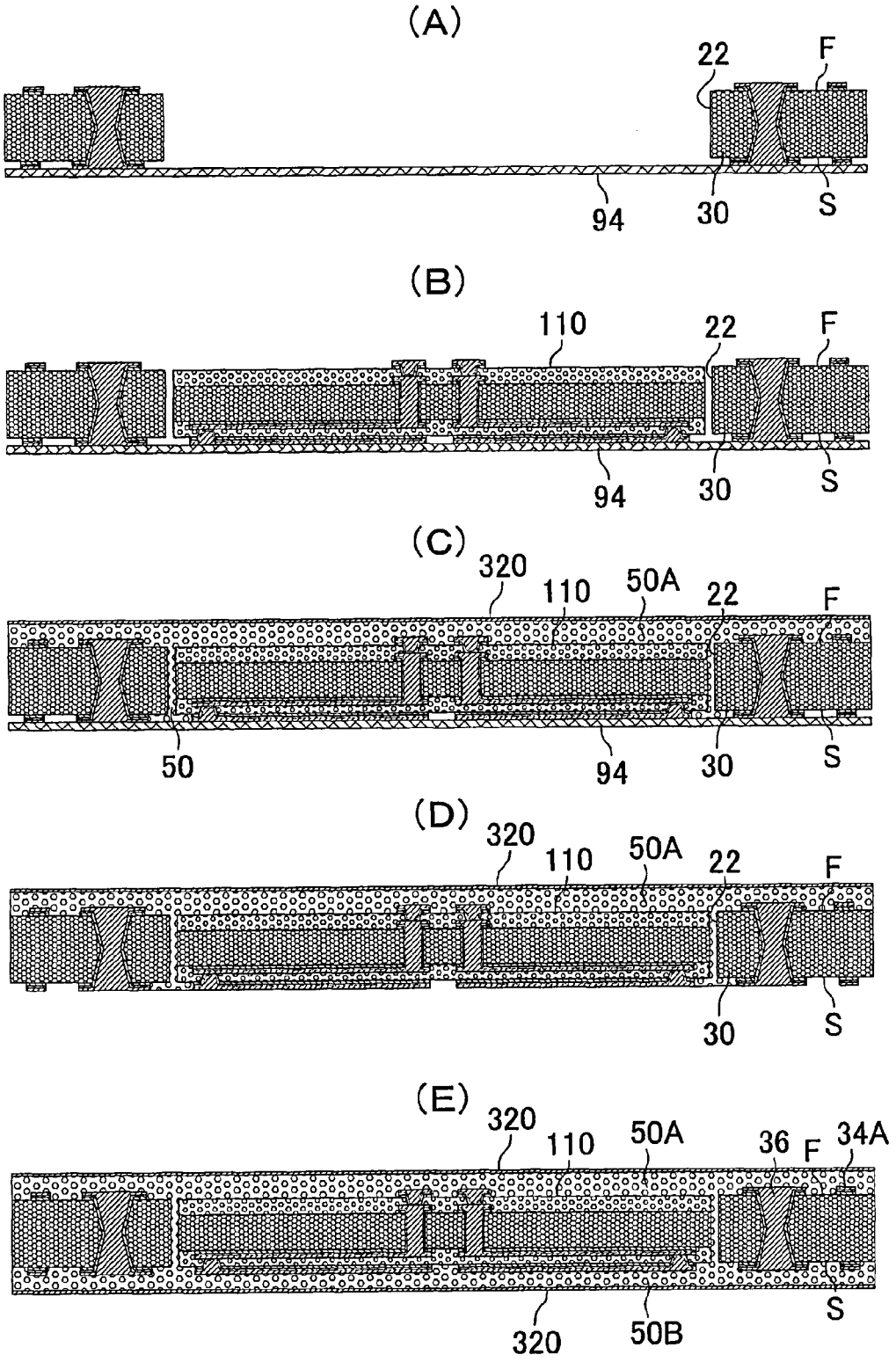
FIGS. 9A to 9E are views illustrating the method for manufacturing the printed wiring board of the first embodiment.
Figure 10:
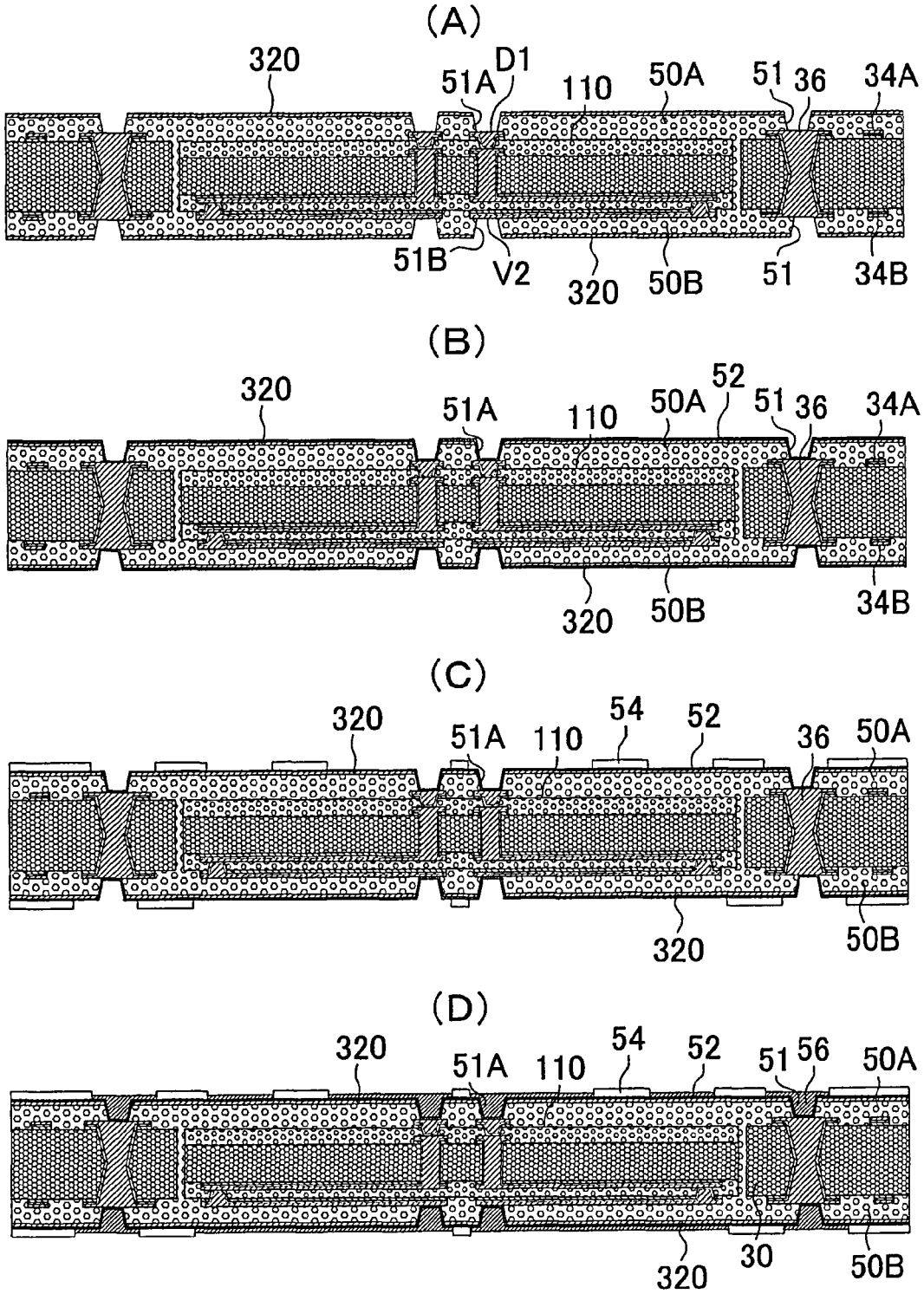
FIGS. 10A to 10D are views illustrating the method for manufacturing the printed wiring board of the first embodiment.
Figure 11:
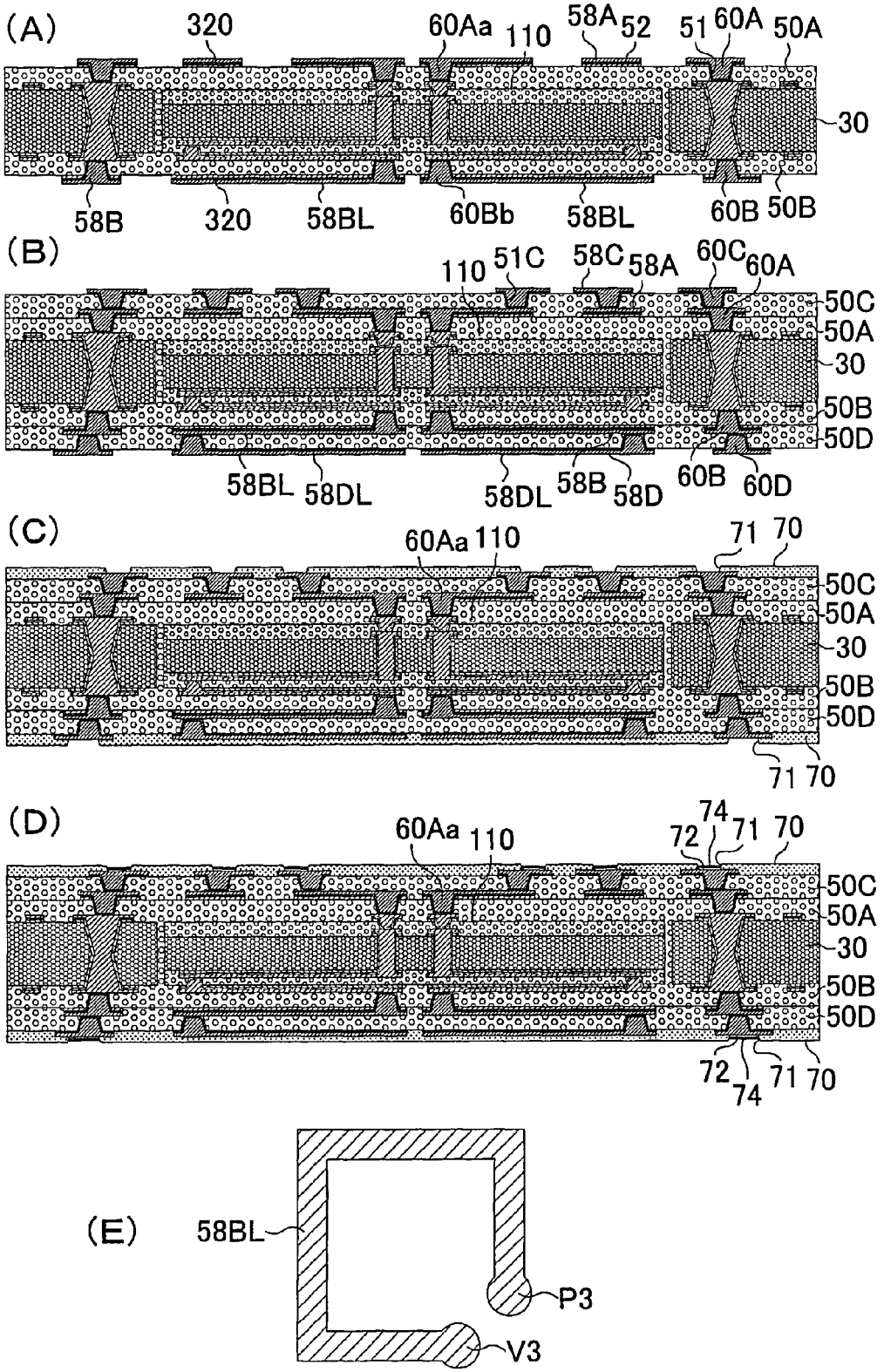
FIGS. 11A to 11E are views illustrating the method for manufacturing the printed wiring board of the first embodiment.

The third coil layer (58BL) and the fourth coil layer (58DL) are connected to each other through the lowermost via conductor (60D). The fourth coil layer (58DL) has a via land (P4) for connection with the lowermost via conductor (60D). The via land (P4) is formed on one end of the fourth coil layer (58DL). The fourth coil layer (58DL) is connected to connection wiring (L10) formed on the other end opposite the via land (P4). A first laminated coil including the first, second, third and fourth coil layers is thereby completed. The first laminated coil is connected to an adjacent second laminated coil. The coil layers of the second laminated coil are formed to be the same as their respective coil layers of the first laminated coil. One end (the end opposite the connection wiring) of the second laminated coil is connected to a land (LO) of the second through-hole conductor (see FIG. 5B). The third buildup layer is formed on a land (LI), the land (LO), and the third surface of the second core substrate, and has via conductors right above the lands (LI, LO). The top surface of a via conductor functions as a first electrode. The via conductor on the land (LI) is a first input electrode (D1) (D1I), and the via conductor on the land (LO) is a first output electrode (D1) (D1O). The connection portion (V2) of the second coil layer in the first laminated coil is the second electrode (second output electrode) and the connection portion (V2) of the second coil layer in the second laminated coil is the second electrode (second input electrode) (see FIG. 5B). The lands (LI, LO) are formed on the third surface of the second core substrate. The lands (LI, P1I) are connected to the same through-hole conductor, and the land (LI) is positioned opposite the land (P1I).

Electric power from a power source is supplied to the input electrode of the inductor component through the upper via conductor (first connection via conductor). Then, the electric power is transmitted to the coil layers in the second buildup layer through the coil layers in the inductor component and the lower via conductor (second connection via conductor), and is further transmitted to the coil layers in the inductor component through the lower via conductor (second connection via conductor). The electric power is transmitted to the IC chip through the output electrode of the inductor component, the upper via conductor (first connection via conductor), and the conductive layer and via conductor in the first buildup layer.

The laminated coil is positioned directly under the IC chip. The laminated coil is preferred to be directly under the processor core of the IC chip. Since such a setting reduces the distance between the IC chip and the inductor, stable power is instantaneously supplied to the IC chip and malfunctioning of the IC chip is prevented.

According to the present embodiment, an inductor is made up of the coil layers in the second buildup layer and coil layers in the inductor component. The printed wiring board of the present embodiment has a higher inductance than a printed wiring board having coil layers only in a buildup layer.

The inductor component has the second core substrate, and does not have any conductive circuit on the third surface of the second core substrate except the land of the second through-hole conductor. The inductor in the printed wiring board is less likely to be affected by the conductive layers in the printed wiring board. The distance between the inductor in the printed wiring board and the upper conductive layer in the first buildup layer is set longer. The interference between the upper conductive layer of the first buildup layer and the inductor therefore weakens, and the inductance value and Q factor of the inductor in the printed wiring board do not decrease.

When the inductor component includes the second core substrate and the upper resin insulation layer of the inductor component, the inductor component does not have any conductive circuit on the third surface of the second core substrate except the land of the second through-hole conductor, and does not have any conductive circuit on the upper resin insulation layer except the electrode. The inductor in the printed wiring board is less likely to be affected by the conductive layers in the printed wiring board. The distance between the inductor in the printed wiring board and the upper conductive layer in the first buildup layer is set longer. The interference between the upper conductive layer of the first buildup layer and the inductor therefore weakens, and the inductance value and Q factor of the inductor in the printed wiring board do not decrease.

The distance between the fourth surface of the second core substrate and the second surface of the first core substrate is shorter than the distance between the third surface of the second core substrate and the first surface of the first core substrate. If a coil layer is formed in the second buildup layer, the volume of the conductive layer in the second buildup layer is smaller than the volume of the conductive layer in the first buildup layer. Due to such difference, warping is apt to occur in the printed wiring board. In the present embodiment, the coil layer is formed only on the fourth surface side of the second core substrate. Accordingly, even when the first buildup layer has no coil layer and the second buildup layer has a coil layer, the difference in the conductor volumes above and below the center line (C) (see FIG. 1) of the printed wiring board is reduced. Warping of the printed wiring board therefore is reduced. When the fourth surface is positioned closer to the second surface, the volume of conductive layers on the second buildup layer side efficiently increases.

The inductor component may be covered with a resin layer containing inorganic particles. The resin layer is not magnetic, and contains a resin such as epoxy resin or the like in addition to the inorganic particles. The bonding strength between the inductor component and the filler resin is thereby enhanced, and malfunctions such as disconnection in the conductive layer of the printed wiring board due to peeling between the inductor component and the filler resin are prevented. As the inorganic particles that are not magnetic, silica particles and alumina particles are listed.

The thickness of the inductor component can be controlled by adjusting the number of resin insulation layers and coil layers in the inductor component, and the inductance value can also be controlled.

In the first embodiment, the buildup layer and the inductor component are manufactured through a technique available in the field of printed wiring board technology. Since the buildup layer and the inductor component are separately manufactured, the thickness of the coil layer in the inductor component is set greater than the thickness of the conductive layers in the first and second buildup layers. Accordingly, an inductor component with a low resistance value is built into the printed wiring board. Moreover, a buildup layer having a fine conductive circuit can be manufactured, and the Q factor of the inductor component is increased.

In the first embodiment, filler resin 50 filled between a side wall of the cavity 22 and the inductor component is preferred to contain magnetic particles. The reduction of inductance value of the inductor component is thereby suppressed.

In the printed wiring board of the first embodiment, the coil layers are formed in the second buildup layer, and the inductor component 110 having the coil layers is built into the first core substrate 30. Since the space for providing wiring in the buildup layer increases, the wiring flexibility of the printed wiring board increases, and desired inductor characteristics (L, Q) are obtained. The power source for a semiconductor device is enhanced. The printed wiring board is made thinner by accommodating the inductor component 110 into the first core substrate 30. By connecting the coil layers in the inductor component and the coil layers in the second buildup layer to each other, it is easier to adjust inductor characteristics.

Method for Manufacturing Inductor Component

FIGS. 4A to 6E show processes for manufacturing an inductor component.

As shown in FIG. 4A, there is prepared a copper-clad laminate (130Z) having copper foil 132 laminated on both sides of the insulating substrate 120. The insulating substrate 120 has the third surface (FF) and the fourth surface (SS) opposite the third surface (FF). The through hole 131 is formed by irradiating the copper-clad laminate (130Z) with a CO2 laser (see FIG. 4B). Electroless copper plating is then applied to the copper-clad laminate (130Z). An electroless plated film 133 is formed as a seed layer on the surfaces of the copper-clad laminate (130Z) and the inner wall of the through hole 131 (see FIG. 4C).

Next, a plating resist 135 is formed (see FIG. 4D). By applying electrolytic copper plating, electrolytic plated film 137 is formed on the electroless plated film 133 exposed from the plating resist 135. The second through-hole conductor 136 is formed in the through hole 131 (see FIG. 5A).

The plating resist 135 is removed, and the electroless plated film 133 and the copper foil 132 between the electrolytic plated films 137 are then removed. The land (134A) of the second through-hole conductor is formed on the third surface of the insulating substrate, and the first coil layer is formed on the fourth surface of the insulating substrate. The first coil layer is connected to the land (P1I) of the second through-hole conductor. The drawing in FIG. 5B includes the coil layer between (W1) and (W2) illustrated in FIG. 5D. The second core substrate 130 is thereby completed (see FIG. 5B).

On the third surface (FF) and fourth surface (SS) of the second core substrate 130, a B-stage prepreg and copper foil 148 are laminated. The prepreg on the third and fourth surfaces of the insulating substrate is cured, and the insulation layers (resin insulation layers) (150A, 150B) are respectively formed on the third and fourth surfaces of the insulating substrate (see FIG. 5C).

By applying CO2 laser from the third-surface side, an opening (151A) reaching the land (134A) of the second through-hole conductor of the inductor component is formed in the resin insulation layer (150A). Likewise, an opening (151B) reaching the connection portion (V1) of the first coil layer (134BL) of the inductor component is formed in the resin insulation layer (150B) (see FIG. 6A).

Through an electroless plating treatment, an electroless plated film 152 is formed on the inner walls of each of the openings (151A, 151B) for forming respective via conductors and on the copper foil formed on the resin insulation layers (150A, 150B) (see FIG. 6B).

A plating resist 154 is formed on the electroless plated film 152 (see FIG. 6C). Through electrolytic plating, electrolytic plated film 156 is formed on the electroless plated film exposed from the plating resist 154 (see FIG. 6D).

The plating resist 154 is removed using 5% NaOH. After that, the electroless plated film 152 and copper foil 148 exposed from the electrolytic copper-plated film are removed by etching. Electrode (D1) made up of the copper foil 148, electroless plated film 152 and electrolytic plated film 156 is formed on the upper resin insulation layer. In FIG. 6E, the left-side electrode is the first input electrode (D1I), and the right-side electrode is the first output electrode (D1O). There is formed the second coil layer (158BL) made up of the copper foil 148, electroless plated film 152 and electrolytic plated film 156 on the lower resin insulation layer in the inductor component. The electrode (D1) and the land (through-hole land) (134A) of the second through-hole conductor are connected to each other through the upper via conductor in the inductor component. The electrode (D1) is formed directly on the through-hole land 134. It is preferred that the electrode be formed on the upper via conductor and its land in the inductor component. The first and second coil layers are connected to each other through the lower via conductor in the inductor component. The via conductor is made up of the electroless plated film 152 and electrolytic plated film 156. On one of its ends, the second coil layer has the second electrode. The inductor component is thus completed (see FIG. 6E). The left-side coil layers in FIG. 6E are included in the first laminated coil, and the right-side coil layers are included in the second laminated coil.

Method for Manufacturing Printed Wiring Board

FIGS. 7A to 11E show the method for manufacturing an inductor component.

(1) A starting substrate having a first surface (F) and second surface (S) is prepared. The starting substrate is preferred to be a double-sided copper-clad laminate. The double-sided copper-clad laminate is made up of the insulative base material 20 having a first surface and a second surface opposite the first surface, and of metal foils (32, 32) laminated on both surfaces (see FIG. 7A). The starting substrate of the first embodiment is the double-sided copper-clad laminate. The thickness of the metal foils (32, 32) is 2 μm. ELC4785TH-G made by Sumitomo Bakelite Co., Ltd. may be used as the double-sided copper-clad laminate. A black-oxide treatment is performed on the surface of the copper foil 32. The insulative base material 20 is made of a resin and reinforcing material. As the reinforcing material, for example, a glass cloth, aramid fibers, glass fibers or the like are named.

(2) CO2 laser is applied to the first surface (F) of the starting substrate, and a first opening portion (31*a*) of a through hole 31 for a first through-hole conductor is formed on the first surface (F) of the starting substrate (see FIG. 7B). The first opening portion (31*a*) is tapered from the first surface (F) toward the second surface (S).

(3) CO2 laser is also applied to the second surface (S) of the starting substrate, and a second opening portion (31*b*) is formed to be connected to the first opening portion (31*a*). Accordingly, a through hole 31 for a first through-hole conductor is formed (see FIG. 7C). The second opening portion (31*b*) is tapered from the second surface (S) toward the first surface (F).

(4) An electroless plated film 33 is formed as a seed layer on the surfaces of the starting substrate and the inner wall of the through hole through an electroless plating treatment (see FIG. 7D).

(5) A plating resist 35 is formed on the seed layer 33 (see FIG. 8A).

(6) Electrolytic treatment is applied to form electrolytic plated film 37 on the seed layer 33 exposed from the plating resist 35. At the same time, the through hole 31 is filled with plating, and the first through-hole conductor 36 is formed (see FIG. 8B).

(7) The plating resist 35 is removed, and the electroless plated film 33 and the copper foil 32 between the electrolytic-plated films 37 are then removed.

(8) In a central part of the insulative base material 20, the cavity (opening) 22 for accommodating the inductor component 110 is formed by using a laser (see FIG. 8D). The cavity 22 penetrates through the insulative base material 20. The first core substrate 30 having the first and second conductive layers (34A, 34B) and the cavity 22 is thus completed (see FIG. 8D).

(9) On the second surface (S) of the first core substrate 30, tape 94 is laminated, and the opening 22 is covered with the tape 94 (see FIG. 9A). As an example of the tape 94, a PET film is listed.

(10) On the tape 94 exposed through the opening 22, the inductor component 110 is placed (see FIG. 9B). The thickness (TI) (see FIG. 2A) of the inductor component 110 accommodated in the opening 22 is 30% to 100% of the thickness (T) of the insulative base material 20. The inductor component 110 is placed on the tape 94 so that the fourth surface of the second core substrate 130 faces the second surface of the first core substrate 30.

(11) On the first surface (F) of the first core substrate 30, a B-stage prepreg and copper foil 320 are laminated. Due to being subjected to heat-pressing, resin seeps from the prepreg into the opening 22, and the opening 22 is filled with the filler (filler resin) 50 (see FIG. 9C). The clearance between the side wall of the opening 22 and the inductor component 110 is filled with the filler, and the inductor component 110 is fixed to the insulative base material 20. Instead of using a prepreg, an interlayer resin insulation layer film may be laminated. A prepreg contains reinforcing material such as a glass cloth or the like, whereas an interlayer resin insulation layer film does not have any reinforcing material, but both are preferred to contain inorganic particles such as silica particles or the like. The clearance between the side wall of the cavity 22 and the inductor component 110 is filled with a resin containing magnetic particles.

(12) After the tape 94 is removed (see FIG. 9D), the B-stage prepreg and copper foil 320 are laminated on the second surface (S) of the first core substrate 30. The prepreg on the first and second surfaces of the insulative base material 20 is cured, and the interlayer insulation layers (interlayer resin insulation layers) (50A, 50B) are formed on the insulative base material 20 (see FIG. 9E).

(13) By applying CO2 laser from the first-surface side, an opening (51A) for the first connection via conductor reaching the first electrode (D1) of the inductor component 110 is formed in the resin insulation layer (50A). At the same time, an opening 51 for a via conductor reaching the first conductive layer (34A) or the first through-hole conductor 36 is formed. From the second-surface side, an opening (51B) for the second connection via conductor reaching the second electrode (V2) of the inductor component 110 is formed in the resin insulation layer (50B). At the same time, the opening 51 for a via conductor reaching the second conductive layer (34B) or the first through-hole conductor 36 is formed (see FIG. 10A).

(14) An electroless plated film 52 is formed on the copper foil formed on the inner wall of the opening for the via conductor and on the interlayer resin insulation layer (see FIG. 10B).

(15) A plating resist 54 is formed on the electroless plated film 52 (see FIG. 10C).

(16) An electrolytic plated film 56 is formed on the electroless plated film 52 exposed from the plating resist 54 through an electroplating treatment (see FIG. 10D).

(17) The plating resist 54 is removed using 5% NaOH. After that, the electroless plated film 52 and copper foil 320 exposed from the electrolytic copper-plated film are removed by etching. The upper and lower resin conductive layers (58A, 58B) are formed, each made up of the electroless plated film 52, electrolytic plated film 56 and copper foil 320. The conductive layers (58A, 58B) each include multiple conductive circuits and the lands of via conductors; for example, the conductive layer (58B) includes the coil layer (58BL) illustrated in FIG. 11E. At the same time, the via conductors (60A, 60B) and connection via conductors (60Aa, 60Bb) are formed, each made up of the electroless plated film 52 and electrolytic plated film 56 (FIG. 11A). The via conductors (60A, 60B) connect the conductive layers and through-hole conductors of the first core substrate 30 to the conductive layers (58A, 58B) on the insulating layers. The first connection via conductor (60Aa) connects the first electrodes (input electrode and output electrode) of the inductor component 110 to the upper conductive layer (58A). The second connection via conductor (60Bb) connects the second electrodes (input electrode and output electrode) of the inductor component 110 to the coil layer (58BL).

(18) By repeating the process of FIGS. 9E to 11A, the uppermost and lowermost interlayer resin insulation layers (50C, 50D) are formed on the interlayer insulation layers (50A, 50B), respectively, and the uppermost and lowermost conductive layers (58C, 58D) are formed on the uppermost and lowermost interlayer resin insulation layers (50C, 50D), respectively. The uppermost and lowermost via conductors (60C, 60D) are formed on the uppermost and lowermost interlayer resin insulation layers (50C, 50D), respectively, and the conductive layers (58A, 58B) and the conductive layers (58C, 58D) are connected to each other through the via conductors (60C, 60D), respectively. The conductive layer (58D) includes, for example, the coil layer (58DL) having the shape illustrated in FIG. 11E. The first buildup layer is formed on the first surface of the insulative base material 20, and the second buildup layer is formed on the second surface of the insulative base material 20. The buildup layers each include insulating layers, conductive layers and via conductors for connecting the conductive layers. In the first embodiment, the first and second buildup layers further include connection via conductors.

(19) On the first and second buildup layers, the solder resist layers 70 each having openings 71 are formed, respectively (see FIG. 11C). The openings 71 expose the top surfaces of the conductive layer and via conductor. The exposed portions each function as a pad.

(20) On the pad, there is formed a metal film made up of a nickel layer 72 and a gold layer 74 on the nickel layer 72 (see FIG. 11D). Instead of nickel/gold layers, a film made of nickel/palladium/gold layers may also be formed.

(21) Then, a solder bump (76F) is formed on the pad of the first buildup layer, and a solder bump (76S) is formed on the pad of the second buildup layer. Accordingly, a printed wiring board 10 having the solder bumps is completed (see FIG. 1).

FIGS. 14A to 14D are plan views of respective coil layers of a printed wiring board according to a modified example of the first embodiment.

Figure 14:
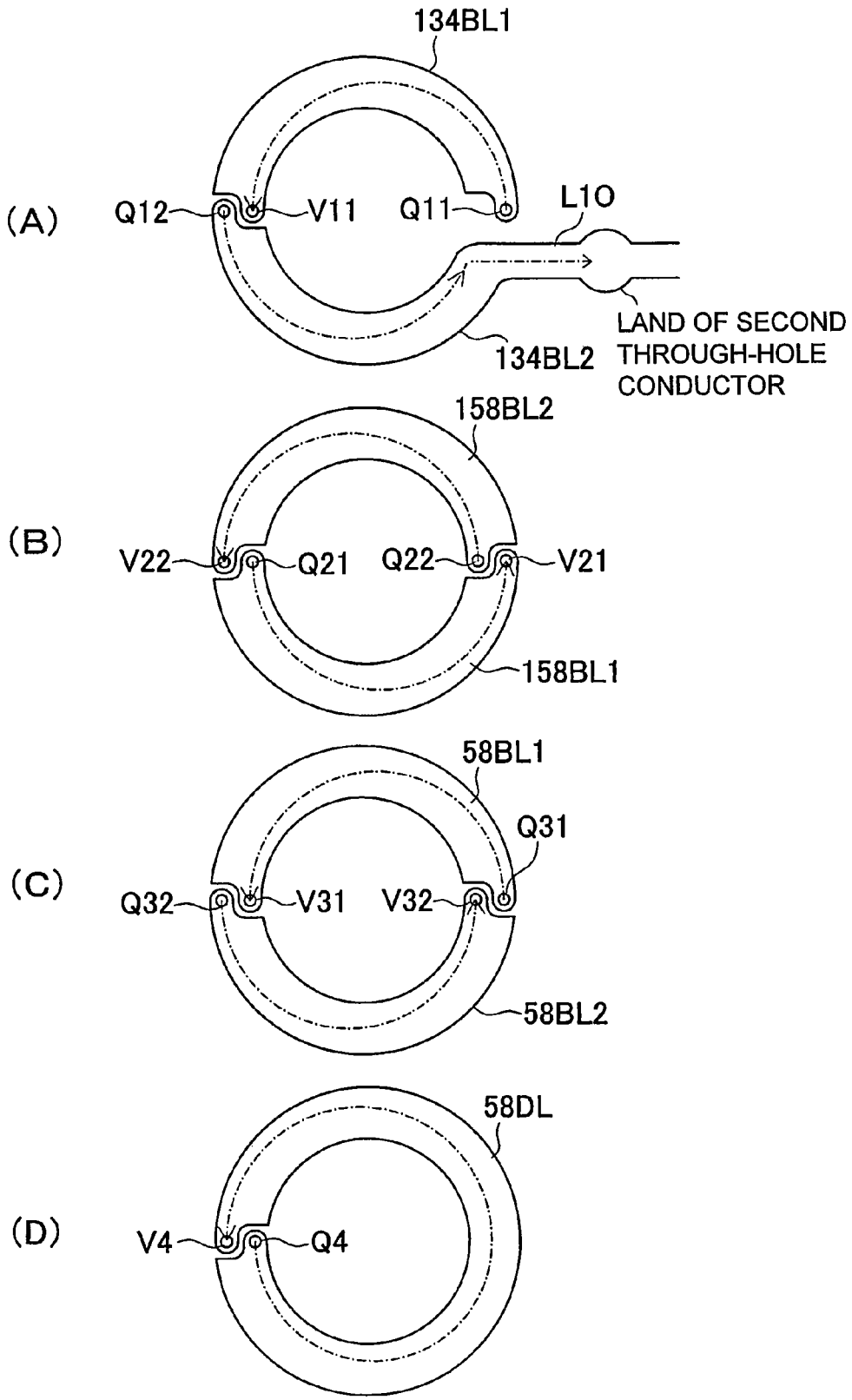
FIGS. 14A to 14D are plan views of coil layers according to a modified example of the first embodiment.

The electric current, which is input to an input (Q11) of a coil layer (first coil layer on the input side) (134BL1) illustrated in FIG. 14A, flows counterclockwise in a semicircle to reach an output (V11). The input (Q11) is the land of a second through-hole conductor. The electric current flows from the output (V11) through the via conductor (160B) (see FIG. 1) to be input to an input (Q21) of a coil layer (second coil layer on the input side) (158BL1) illustrated in FIG. 14B. The electric current flows counterclockwise in a semicircle along the coil layer (158BL1) to reach an output (second output electrode) (V21), and flows from the output (V21) through the via conductor (60B) (see FIG. 1) to be input to an input (Q31) of a coil layer (third coil layer on the input side) (58BL1) illustrated in FIG. 14C. The electric current flows counterclockwise in a semicircle along the coil layer (58BL1) to reach an output (V31), and flows from the output (V31) through the via conductor (60D) (see FIG. 1) to be input to an input (Q4) of the coil layer (fourth coil layer on the input side) (58DL) illustrated in FIG. 14D. The electric current flows counterclockwise in a semicircle along the coil layer (58DL) to reach an output (V4), and flows from the output (V4) through the via conductor (60D) (see FIG. 1) to be input to an input (Q32) of a coil layer (third coil layer on the output side) (58BL2) illustrated in FIG. 14D. The electric current flows counterclockwise in a semicircle along the coil layer (58BL2) to reach an output (V32), and flows from the output (V32) through the via conductor (60B) (see FIG. 1) to be input to an input (Q22) of a coil layer (second coil layer on the output side) (158BL2) illustrated in FIG. 14B. The electric current flows counterclockwise in a semicircle along the coil layer (158BL2) to reach an output (V22), and flows from the output (V22) through the via conductor (160B) (see FIG. 1) to be input to an input (Q12) of a coil layer (first coil layer on the output side) (134BL2) illustrated in FIG. 14A. Then, the electric current flows counterclockwise in a semicircle along the coil layer (134BL2) to reach a connection line (L1O). The laminated coil illustrated in FIGS. 14A to 14D are connected to an adjacent similar laminated coil through the connection line. The coil layers (134BL1, 134BL2) are formed on the fourth surface of the second core substrate; the coil layers (158BL1, 158BL2) are formed on the lower resin insulation layer in the inductor component; the coil layers (58BL1, 58BL2) are formed on the lower interlayer resin insulation layer of the second buildup layer; and the coil layer (58DL) is formed on the lowermost interlayer resin insulation layer of the second buildup layer. The connection line (L1O) may be connected to the land of the second through-hole conductor. The multiple laminated coils are connected in parallel to the one land of the second through-hole conductor.

The first, second and third coil layers illustrated in FIGS. 14A to 14D are each made up of input-side coil layers and output-side coil layers; the first coil layers are made up of input-side first coil layers and output-side first coil layers; the second coil layers are made up of input-side second coil layers and output-side second coil layers; and the third coil layers are made up of input-side third coil layers and output-side third coil layers.

Second Embodiment

Figure 12:
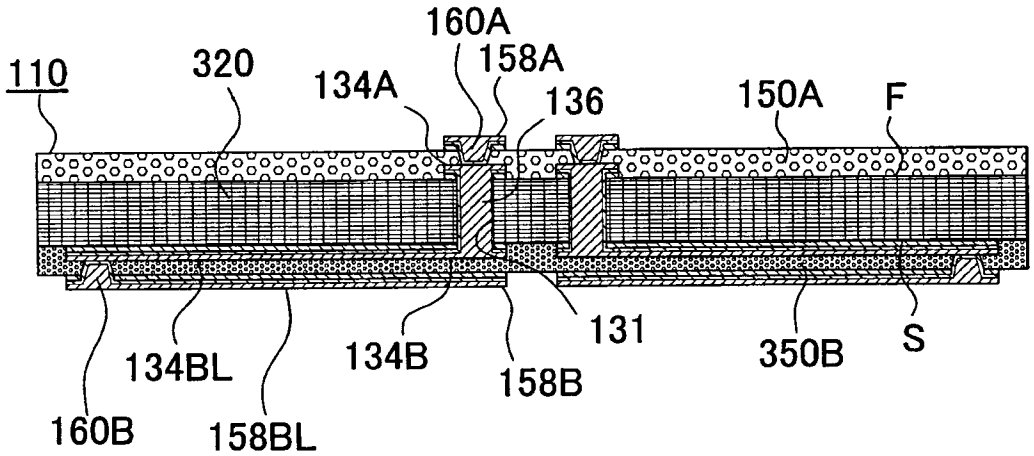
FIG. 12 is a cross-sectional view of an inductor component of a second embodiment of the present invention.

FIG. 12 shows an inductor component 110 of the printed wiring board according to a second embodiment. In the inductor component 110 of the second embodiment, magnetic particles are contained in an insulating substrate 320. Likewise, a lower resin insulation layer (350B) contains magnetic particles. Even higher inductance is obtained in the printed wiring board of the second embodiment. The inductor component 110 illustrated in FIG. 12 is built into a first core substrate 30, the same as with the first embodiment.

Figure 13:
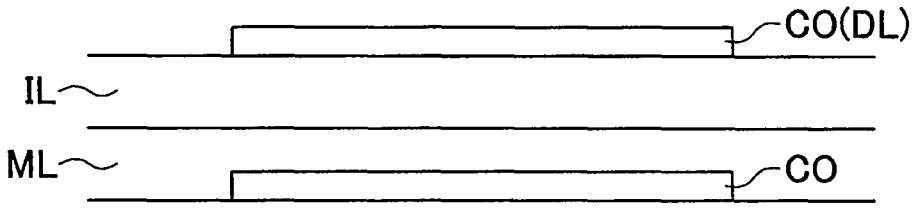
FIG. 13 is a view showing a portion of the inductor component of the second embodiment.

As illustrated in FIG. 13, dual insulating layers (IL, ML) may be formed on a coil layer (CO). The dual insulating layers are made up of a magnetic layer (ML) containing magnetic particles and resin, and a resin film (IL) containing inorganic particles other than magnetic particles and resin. The magnetic layer (ML) is formed on the coil layer (CO), the resin film (IL) is formed on the magnetic layer (ML), and then the coil layer (CO) and a conductive layer (DL) are formed on the resin film (IL) (see FIG. 13).

When a thick inductor is bonded on a substrate, the thickness of the interlayer insulation layer for accommodating the inductor increases, and the substrate with the built-in inductor is thought to become thicker.

Due to a greater thickness of the inductor, the thickness of the interlayer insulation layer for accommodating the inductor is thought to be greater than that of other interlayer insulation layers, and warping may therefore occur in the substrate with the built-in inductor.

When a substrate with a built-in inductor has via conductors in an interlayer insulation layer for accommodating the inductor and also in the other interlayer insulation layers, the interlayer insulation layer for accommodating the inductor is thicker than the other interlayer insulation layers, and the opening portion for a via conductor formed in the interlayer insulation layer is thought to be deeper and cause the connection reliability to be reduced.

Also, since the inductor component is bonded on a substrate, the flexibility of designing wiring is thought to be lowered.

When an inductor is bonded on a substrate, and it is thought to be difficult to accommodate an inductor formed with multiple coil layers. Accordingly, obtaining high inductance is thought to be difficult.

A printed wiring board according to an embodiment of the present invention has a built-in inductor having high inductance and a high Q factor and reduces warping of the printed wiring board with a built-in inductor.

A printed wiring board according to one aspect of the present invention includes the following: a first core substrate which has a first surface and a second surface opposite the first surface and is provided with an opening for accommodating an inductor component; an inductor component accommodated in the opening of the first core substrate; a first buildup layer formed on the first surface of the first core substrate and on the inductor component; and a second buildup layer which is formed on the second surface of the first core substrate and on the inductor component and is provided with a third coil layer. The inductor component is made up of a second core substrate having a third surface and a fourth surface opposite the third surface, and of a fourth buildup layer which is formed on the fourth surface of the second buildup layer and is provided with a second coil layer. The second and third coil layers are connected to each other through a via conductor of the second buildup layer.

A printed wiring board according to another aspect of the present invention includes the following: a first core substrate which has a first surface and a second surface opposite the first surface and is provided with an opening for accommodating an inductor component; an inductor component accommodated in the opening of the first core substrate; a first buildup layer formed on the first surface and on the inductor component; and a second buildup layer which is formed on the second surface of the first core substrate and on the inductor component and is provided with a third coil layer. The inductor component is made up of an insulating substrate having a third surface and a fourth surface opposite the third surface, an electrode formed on the third surface of the insulating substrate, and a first coil layer on the fourth surface of the insulating substrate. The second and third coil layers are connected to each other through a via conductor of the second buildup layer.

Obviously, numerous modifications and variations of the present invention are possible in light of the above teachings. It is therefore to be understood that within the scope of the appended claims, the invention may be practiced otherwise than as specifically described herein.

What is claimed is:

1. A printed wiring board, comprising:

a first core substrate having an opening portion;

an inductor component accommodated in the opening portion of the first core substrate;

a first buildup layer formed on a first surface of the first core substrate and comprising an interlayer insulation layer, a conductive layer formed on the interlayer insulation layer in the first buildup layer, and a via conductor such that the first buildup layer is covering the inductor component and that the via conductor in the first buildup layer is connected to the inductor component in opening portion; and a second buildup layer formed on a second surface of the first core substrate on an opposite side with respect to the first surface of the first core substrate and comprising an interlayer insulation layer, a conductive layer formed on the interlayer insulation layer in the second buildup layer, and a via conductor such that the second buildup layer is covering the inductor component and that the via conductor in the second buildup layer is connected to the inductor component in the opening portion, wherein the inductor component has a second core substrate, a buildup layer formed on a surface of the second core substrate and a coil layer formed on the buildup layer, and the second buildup layer is formed such that the conductive layer in the second buildup layer has a coil layer and that the via conductor in the second buildup layer is connecting the coil layer in the second buildup layer and the coil layer formed on the buildup layer in the inductor component.

2. The printed wiring board according to claim 1, wherein the inductor component has a plurality of coil layers consisting of a coil layer formed on the surface of the second core substrate and the coil layer formed on the buildup layer in the inductor component.

3. The printed wiring board according to claim 1, wherein the inductor component has the second core substrate comprising an insulating substrate, a third buildup layer formed on a surface of the insulating substrate and a fourth buildup layer forming the buildup layer on the surface of the second core substrate on an opposite side with respect to the third buildup layer, the inductor component further includes a through-hole conductor structure penetrating through the insulating substrate, a coil layer formed on the surface of the insulating substrate having the fourth buildup layer and a through-hole land structure formed at an end of the through-hole structure on the surface of the insulating substrate having the third buildup structure, the third buildup layer in the inductor component includes an interlayer insulation layer formed on the through-hole land structure, an electrode formed on the interlayer insulation layer and a via structure formed through the interlayer insulation layer and connecting the electrode and the through-hole structure, and the fourth buildup layer in the inductor component includes an interlayer insulation layer formed on the coil layer on the surface of the insulating substrate having the fourth buildup layer, and a via structure formed through the interlayer insulation layer in the fourth buildup layer and connecting the coil layer on the surface of the insulating substrate having the fourth buildup layer and the coil layer formed on the fourth buildup layer in the inductor component.

4. The printed wiring board according to claim 3, wherein the inductor component has a plurality of coil layers consisting of the coil layer on the surface of the insulating substrate having the fourth buildup layer and the coil layer formed on the fourth buildup layer in the inductor component.

5. The printed wiring board according to claim 1, wherein the first core substrate and the second core substrate are formed such that the surface of the second core substrate having the buildup layer is formed closer to the second surface of the first core substrate with respect to the first surface of the first core substrate.

6. The printed wiring board according to claim 1, wherein the inductor component has the second core substrate comprising an insulating substrate which has a thickness of 100 μm or greater.

7. The printed wiring board according to claim 1, wherein the conductive layer in the first buildup layer and the second core substrate are formed such that a distance between the conductive layer and the surface of the second core substrate having the buildup layer is 100 μm or greater.

8. The printed wiring board according to claim 1, wherein the first buildup layer has a pad structure configured to mount an IC chip device and comprising a plurality of pads.

9. The printed wiring board according to claim 1, wherein the second buildup layer has a pad structure configured to mount a mother board IC chip device and comprising a plurality of pads.

10. The printed wiring board according to claim 1, wherein at least one of the second core substrate and the buildup layer in the inductor component includes magnetic particles.

11. The printed wiring board according to claim 1, wherein the first buildup layer has a pad structure configured to mount an IC chip device and comprising a plurality of pads, and the second buildup layer has a pad structure configured to mount a mother board IC chip device and comprising a plurality of pads.

* * * * *